US008638264B2

(12) United States Patent
Hall

(10) Patent No.: US 8,638,264 B2
(45) Date of Patent: Jan. 28, 2014

(54) PIVOT RADAR

(75) Inventor: Richard R. Hall, Baldwinsville, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 394 days.

(21) Appl. No.: 12/729,931

(22) Filed: Mar. 23, 2010

(65) Prior Publication Data

US 2011/0234464 A1 Sep. 29, 2011

(51) Int. Cl.
*H01Q 3/00* (2006.01)

(52) U.S. Cl.
USPC ..... 343/766; 343/765; 343/757

(58) Field of Classification Search
USPC ..... 343/765, 766
See application file for complete search history.

(56) References Cited

U.S. PATENT DOCUMENTS

| | | | | |
|---|---|---|---|---|
| 3,296,621 | A * | 1/1967 | Lapp | 343/765 |
| 5,469,182 | A * | 11/1995 | Chaffee | 343/882 |
| 6,111,542 | A * | 8/2000 | Day et al. | 342/359 |
| 6,218,999 | B1 | 4/2001 | Bousquet et al. | |
| 6,404,385 | B1 | 6/2002 | Croq et al. | |
| 6,407,714 | B1 | 6/2002 | Butler et al. | |
| 6,486,845 | B2 | 11/2002 | Ogawa et al. | |
| 6,512,490 | B1 | 1/2003 | Lee | |
| 6,812,904 | B2 | 11/2004 | Tietjen | |
| 6,911,950 | B2 * | 6/2005 | Harron | 343/766 |

* cited by examiner

*Primary Examiner* — Hoang V Nguyen
*Assistant Examiner* — Kyana R McCain
(74) *Attorney, Agent, or Firm* — Howard IP Law Group, PC

(57) ABSTRACT

A radar antenna system comprises a base. A center support is coupled to the base on a first end. A radar array is pivotally coupled to a second end of the center support. At least two actuators are provided for pivoting the radar array about the center support, altering its azimuth position.

17 Claims, 6 Drawing Sheets

PIVOT RADAR

FIELD OF THE INVENTION

The present invention relates to scanning radar systems, more particularly to an articulating radar antenna array which does not utilize traditional rotational movement.

BACKGROUND

Radar systems typically utilize a large scanning antenna array mounted on a rotating platform to revolve the antenna array in the azimuth direction. These rotatable platforms allow the array to be oriented at a particular azimuth angle, or to sweep the array through an entire range of azimuth angles at a predetermined angular rate. In traditional rotating radar systems, one end of the antenna array is pivotally mounted to the rotating platform, forming a cantilevered arrangement in which the array can be tilted to a desired elevation angle with respect to the ground by, for example, a hydraulic linear actuator. In this cantilevered configuration the antenna array often has a center of mass offset vertically and/or horizontally from the center of the rotating platform. The hydraulic actuator and tilting arrangement used to set the tilt angle can create in inaccuracies in the positioning of the antenna array. This is known as the system's pointing error.

Traditional approaches used to rotate the platforms include various conventional drive systems supported by numerous rolling element bearings. These bearings, most notably the main support bearings of the rotatable platforms, are subject to significant load from both the weight of the cantilevered antenna arrays, as well as the large forces acting thereon from dynamic imbalances and wind/ice/snow acting on the exposed surfaces of the antenna array due to above-described offset of the center of mass. These forces can result in the fatigue and eventual failure of the bearings and other driveline components.

Further, the rotational motion of the antenna arrays necessitates the use of components such as slip-rings, for providing the array with power, as well as rotary joints for providing liquid coolant. In addition to reliability issues, slip-rings impose significant power limitations on the system. Likewise, rotary fluid joints are prone to leaking.

Accordingly, a system which eliminates the inherent drawbacks of rotating antenna arrangements is desired, as well as a system that eliminates the need for the typical separate subsystems for leveling the radar base, tilting the antenna array, and rotating it.

SUMMARY

In one embodiment of the present invention, a radar system includes an antenna array pivotally mounted to a first end of a center support. A second end of the center support is attached to a base portion. At least two actuators are attached to the antenna array and configured to pivot the antenna array around the center support, altering both its angle of tilt with respect to the ground as well as its azimuth position with respect to the center support. The antenna array is capable of achieving 360° of azimuth revolution by way of this pivoting motion.

DETAILED DESCRIPTION OF PREFERRED EMBODIMENTS

Figure 1:
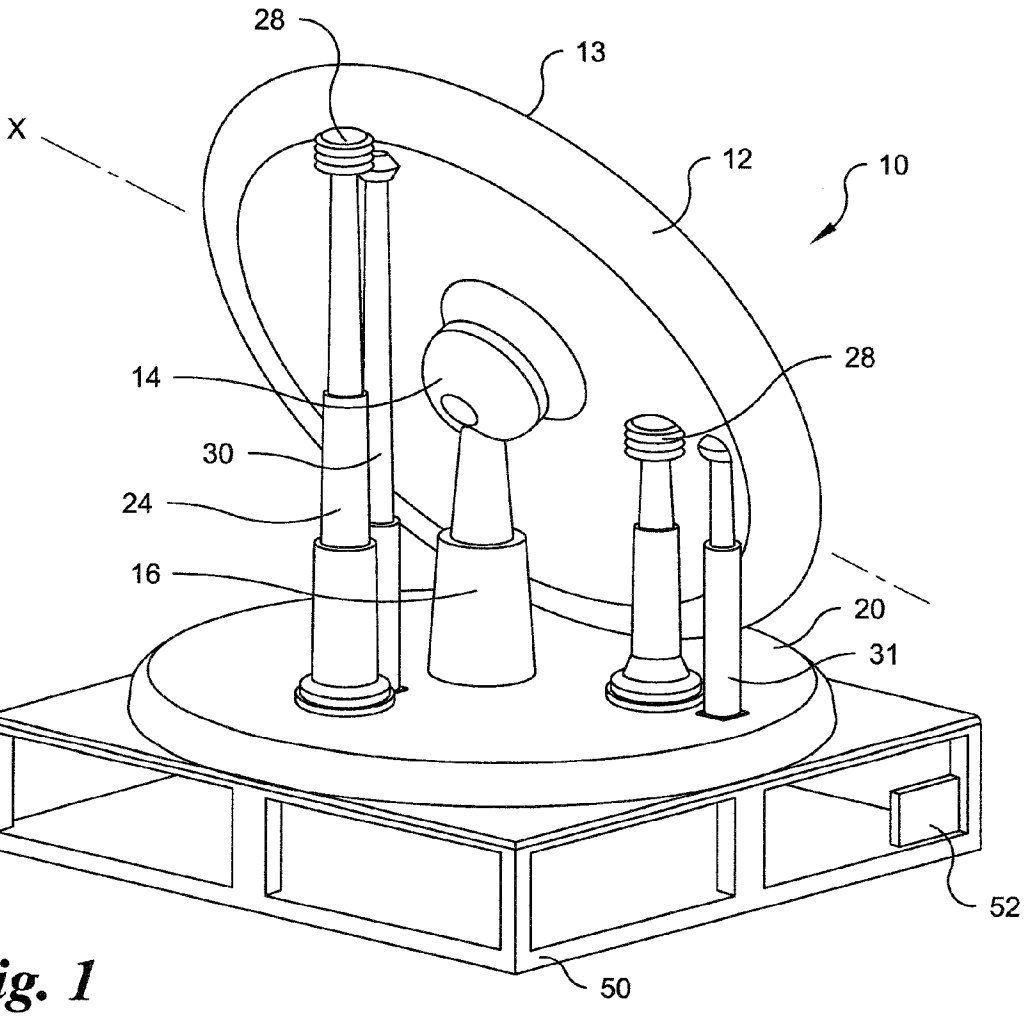
FIG. 1 is an isometric view of an exemplary radar system according to an embodiment of the present invention with the antenna array pivoted about an x-axis only.

Reference will now be made in detail to the present exemplary embodiments of the invention, examples of which are illustrated in the accompanying drawings.

FIGS. 1-4 show a first embodiment of the radar system 10 of the present invention. The radar system 10 comprises an antenna array 12 including an outer face 13 attached to a base portion 20. The antenna array 12 is attached to base portion 20 by a support, for example a center support 16. Center support 16 may be attached at a first end to the base portion 20 by any conventional fastening means. On a second end, the center support 16 is attached to the antenna array 12 at a generally central location thereon. Because the antenna array 12 is supported at its center of mass, this arrangement provides an inherently balanced design. Accordingly, many of the problems associated with the traditional cantilevered antenna arrays and their dynamic imbalance are eliminated.

The antenna array 12 is pivotally attached to the center support 16 via a spherical bearing 14, such as a pedestal air bearing. The use of the spherical bearing 14 provides for low friction operation, a high degree of articulation in all directions between the center support 16 and the antenna array 12, and a high load-carrying capacity. While the use of a spherical bearing is preferred, it is envisioned that other connection means may be utilized between the antenna array 12 and the center support 16 to provide a similarly pivotal arrangement. For example, flexures, hinges, or bushings may all be used without departing from the scope of the present invention.

In a preferred embodiment, the center support 16 is the primary support means for the antenna array 12. The center support 16 may comprise a telescoping or otherwise extendable member moveable between a first retracted position, a second extended position, and any intermediate position therebetween. This moveable arrangement provides for both compact positioning of the antenna array 12 during storage or transportation in the first position (FIG. 4), as well as improved articulation capabilities of the antenna array 12 when the center support 16 is in the second extended position. The center support 16 may be electrically, pneumatically, or hydraulically powered, or may comprise a manual lifting and retracting arrangement.

Figure 3:
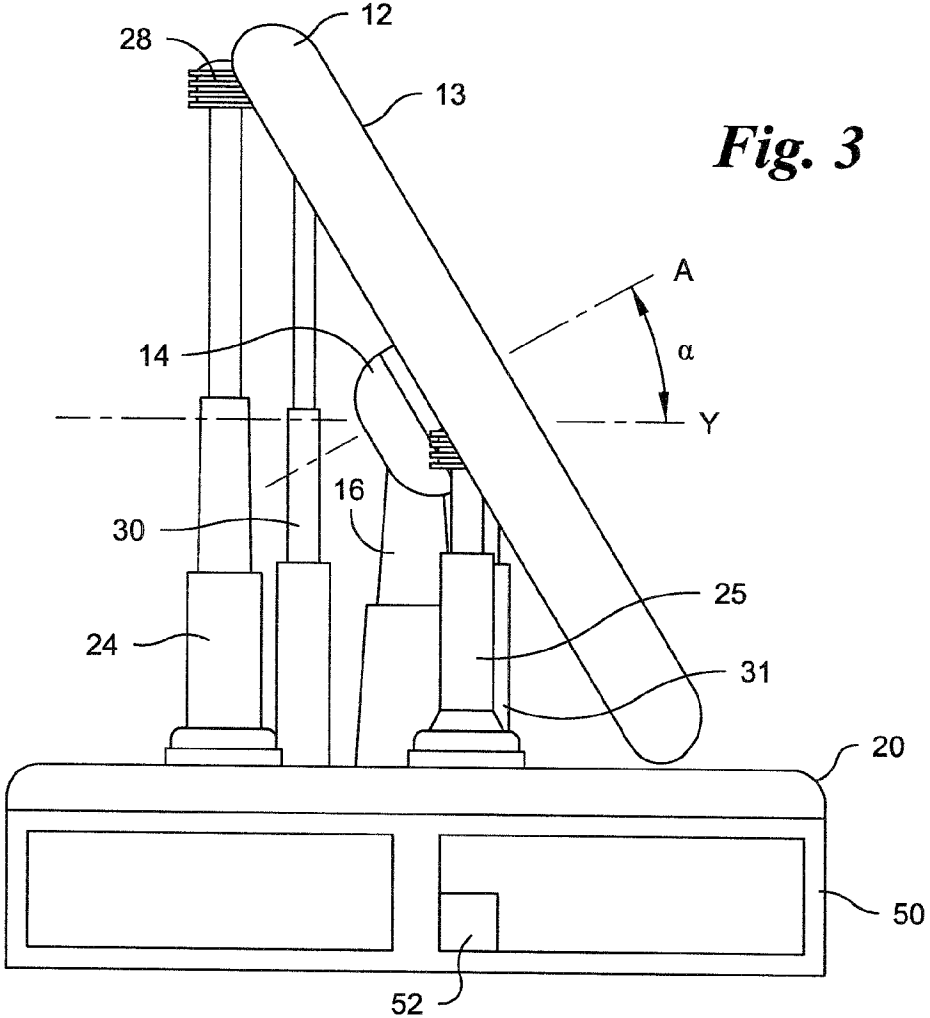
FIG. 3 is a side view of the radar system of FIG. 1.

Antenna array 12 may be supported and sustained in a tilted position, so that the axis "A" is maintained at a constant tilt angle $\alpha$ with respect to a horizontal plane formed generally parallel to the base 20. (FIG. 3). The pivoting arrangement also provides the antenna array 12 with 360° of azimuth revolution. Specifically, the outer face 13 of the antenna array 12 can be oriented facing generally away from the center support 16, at an angle $\alpha$, over a 360° range with respect to the center support 16. Moreover, the highly pivotal nature of the spherical bearing 14 allows for a wide range of positioning options for the radar system 10 in the field. For example, in the case of a mobile radar arrangement mounted to, for example a vehicle, the radar may still achieve a desired tilt angle α despite the vehicle being position on an unlevel road or hillside.

Figure 2:
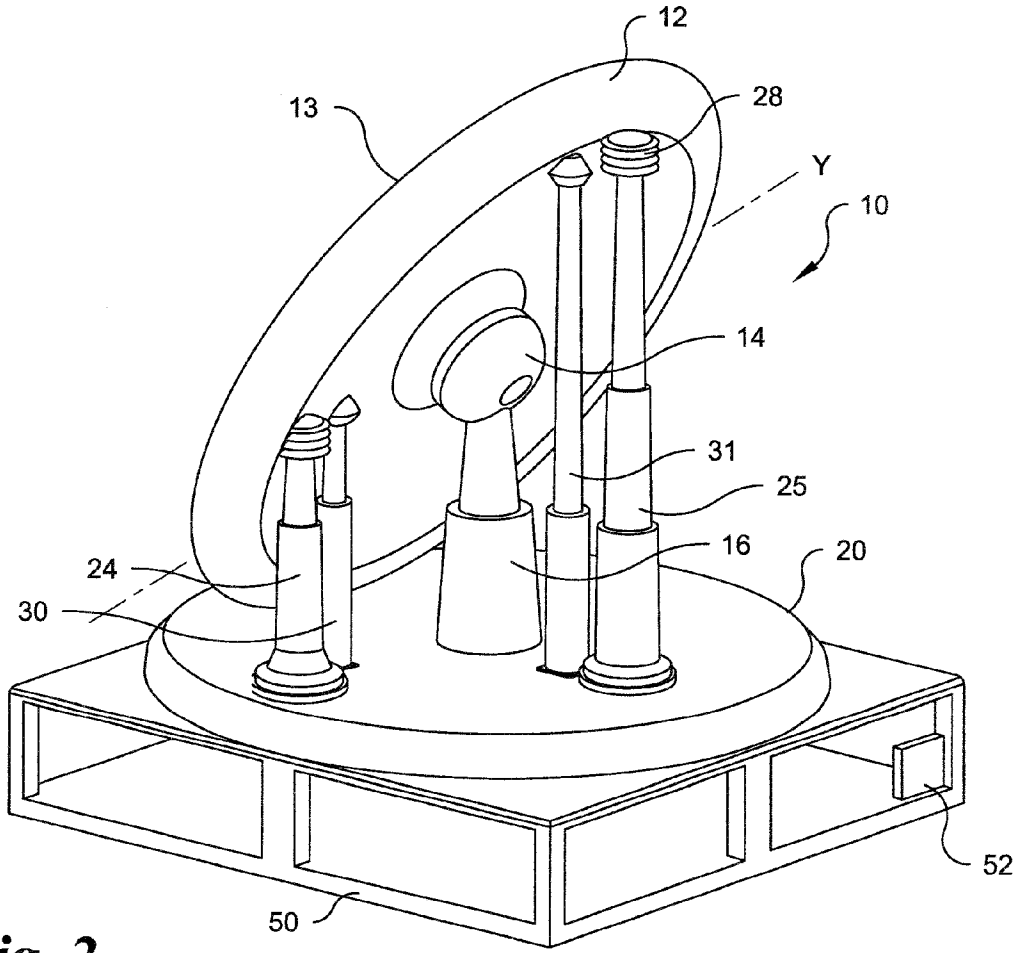
FIG. 2 is an isometric view of the radar system of FIG. 1, with the antenna array pivoted about a y-axis only.

In a preferred embodiment, the antenna array 12 is both tilted and oriented in the azimuth direction by a first and second actuator 24,25 arranged between the base portion 20 and the antenna array 12. In order to achieve the desired 360° of azimuth coverage and desired tilt angle α, the antenna array 12 is pivotable about both an x and y axis (shown in FIGS. 1 and 2 respectively) both independently and simultaneously. For example, FIG. 1 shows the antenna array 12 pivoted around an x-axis only. To achieve this orientation, the first actuator 24 is generally extended (the degree of which is dependent on the desired tilt angle α), while the second actuator 25 is arranged in an intermediate position. Similarly, FIG. 2 shows the antenna array 12 pivoted around only a y-axis, with the first actuator 24 in an intermediate position, and the second actuator 25 in a generally extended position. It can be envisioned that simultaneous pivoting about both the x and y axes, in varying degrees, provides for altering both the tilt angle α and 360° of azimuth coverage with respect to the center support 16. It should be understood that the degree in which the actuators 24,25 must be extended or retracted to achieve a given orientation of the antenna array 12 is dependent on their positioning with respect to the center support 16 and the antenna array 12. Thus, other arrangements exist beyond those shown and described herein to accomplish the same motion.

The actuators 24,25 are preferably telescoping, electromechanical linear actuators. In a preferred embodiment, the actuators 24,25 comprise lead screw-type actuators. As requirements for improved radar accuracy and the ability to detect smaller and smaller targets increase, so does the need for increased control of the antenna array positioning. Accordingly, lead-screw actuators with precise position monitoring are desirable as a result of their superior control and inherent reliability. However, other embodiments may utilize any suitable type of actuator, such as piston-cylinder arrangements that may be electrically, pneumatically, or hydraulically powered, by way of example only.

The position monitoring of the antenna array 12 may be accomplished by, for example, encoders placed on the actuators 24,25. Moreover, at least one sensor and/or an inertial navigation unit (INU) located within the antenna array 12 may be provided for monitoring the angular position of the antenna array 12. A controller is provided which alters the position of the actuators 24,25. The controller may utilize an array mapping routine to correlate the antenna array's rotational orientation to the system's reference coordinate system.

The drive actuators 24,25 may be coupled to the antenna array 12 by any conventional means. In a preferred embodiment of the radar system 10, the drive actuators 24,25 are coupled to the antenna array 12 by bushings, such as elastomeric bushings 28. Elastomeric bushings 28 provide structural integrity and high-load carrying capabilities, durability, and a 360° range of motion to facilitate multi-axis articulation between the antenna array 12 and the drive actuators 24,25 as the antenna array 12 is moved between various azimuth and tilt positions. In alternative embodiments, the drive actuators 24,25 may be coupled to the antenna array 12 by other means, for example spherical bearings, hinges, or flexures to achieve the multi-axis articulation required for proper operation.

While the exemplary figures show the actuators 24,25 arranged generally vertically, or perpendicular to the base 20, other configurations may warrant different orientations. For example, the actuators 24,25 could be arranged perpendicularly to the antenna array 12, with the elastomeric bushing arranged on the base 20. Further still, the actuators 24,25 could be pivotally connected to both the base 20 and the antenna array 12 using elastomeric bushings on both ends of the actuators 24,25. In this way, the actuators 24,25 may provide a more advantageous load path between the antenna array 12 and the base 20, improving the structural support provided to the antenna array 12, therefore replacing the stay braces or back stays used on radar systems of the prior art.

As described above, the system 10 of the present invention provides the same radar coverage of convention rotating radar systems, without resorting to traditional rotational movement, and thus the above-described drawbacks associated with the components required to achieve said rotation. Further, both the tilt angle α of the antenna array 12 and the azimuth position are controlled by the same components. This is unlike traditional systems which employ separate systems, for example a set of at least three linear actuators to level the radar base, a linear actuator to control the tilt of the antenna array, and a rotational drive mechanism to alter the azimuth orientation. In accordance with embodiments of the present invention, complexity, cost, and weight reductions may be realized over the prior art arrangements.

Figure 4:
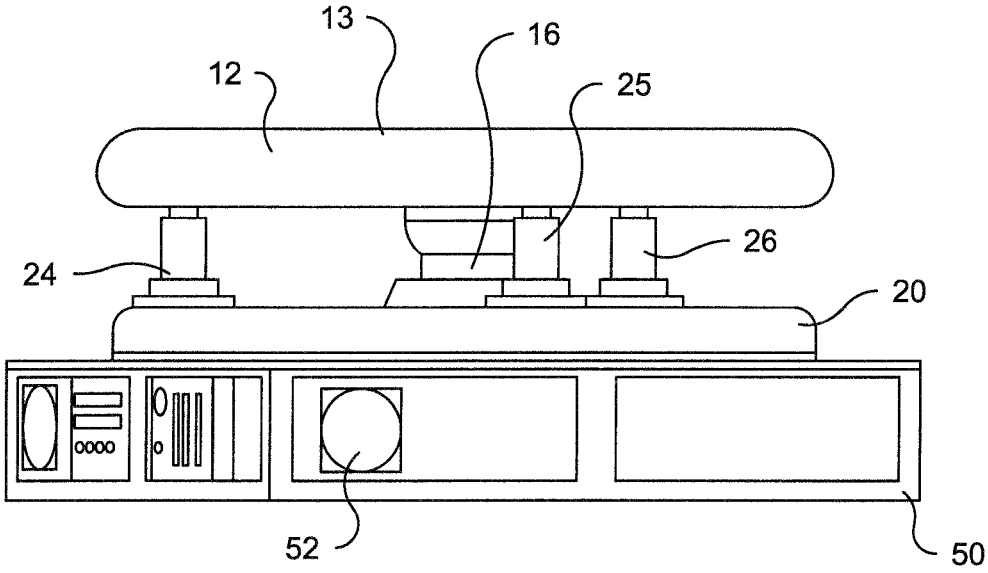
FIG. 4 is a side view of the radar system of FIG. 1 in a storage or transport position.

FIG. 4 shows the radar system 10 in a storage or transport position. The telescoping ability of the center support 16 and the actuators 24,25 allow the antenna array 12 to retract into a generally perpendicular orientation with respect to the base 20, thus creating an efficient position for transportation or storage of the radar system 10.

Referring again to FIGS. 1-3, another embodiment of the radar system 10 may further comprise telescoping counterbalances 30,31 arranged between the base 20 and the antenna array 12. The counterbalances 30,31 are configured to provide additional support to the antenna array 12. The counterbalances 30,31 can be used to counteract forces placed on the surfaces of the antenna array 12, for example, loads generated by wind/ice/snow, as well as any dynamic imbalances caused by the articulation of the antenna array 12. In this way, the counterbalances 30,31 can be used to alter the stiffness of the antenna array 12, adjusting its natural frequency, thus allowing the system to compensate for a variety of operating conditions and desired operating parameters.

The counterbalances 30,31 may be most effectively arranged proximal to the outer edges of antenna array 12, supporting the portions of the antenna array 12 likely to experience the most deflection. However, the counterbalances 30,31 may be placed anywhere support is deemed most effective, and/or dictated by packaging constraints. As described above with respect to the actuators 24,25, the counterbalances 30,31 may be mounted in various orientations with respect to the base and the antenna array beyond the generally vertical position shown in order to improve the support provided. The counterbalances 30,31 may comprise linear actuators like those used for the drive actuators 24,25, but may also comprise dampeners, springs, or other suitable components, preferably with telescoping ability.

In an alternative arrangement, the counterbalances 30,31 may be utilized to provided additional motion control, for example, dampening the motion of the antenna array 12 as it is pivoted. This may be particularly important during high-speed sweeps of the antenna array 12, wherein the forces generated in the antenna due to quickened acceleration and deceleration of the antenna array 12 are greater. In either configuration, the use of counterbalances 30,31 provides for the active dynamic adjustment of the antenna array 12, providing significant tuneability and stability control over the arrangements of the prior art.

Still referring to FIGS. 1-4, the base 20 may further comprise a housing 50 for the storage of the radar electronics 52 including an inertial navigation/movement unit (INU/IMU), and controllers associated with the actuators and counterbalances. The INU/IMU may also be located at the center of the array, thus eliminating the inaccuracies associated with remote mounting in traditional arrangements. The housing 50 may further comprise an onboard power-supply and a compressor or hydraulic pump to supply any of the center support 16, pedestal bearing 14, actuators 24,25, and/or counterbalances 30,31 with pressurized fluids, air, or power. Accordingly, the radar system 10 may comprise a portable system capable of independent operation. Likewise, power and/or a pressurized air or fluid supply can be provided by outside sources, including those found on support vehicles typically used in mobile radar arrangements. It should be noted that the housing 50 may also comprise the base portion of the system as described above without departing from the scope of the present invention.

Figure 5:
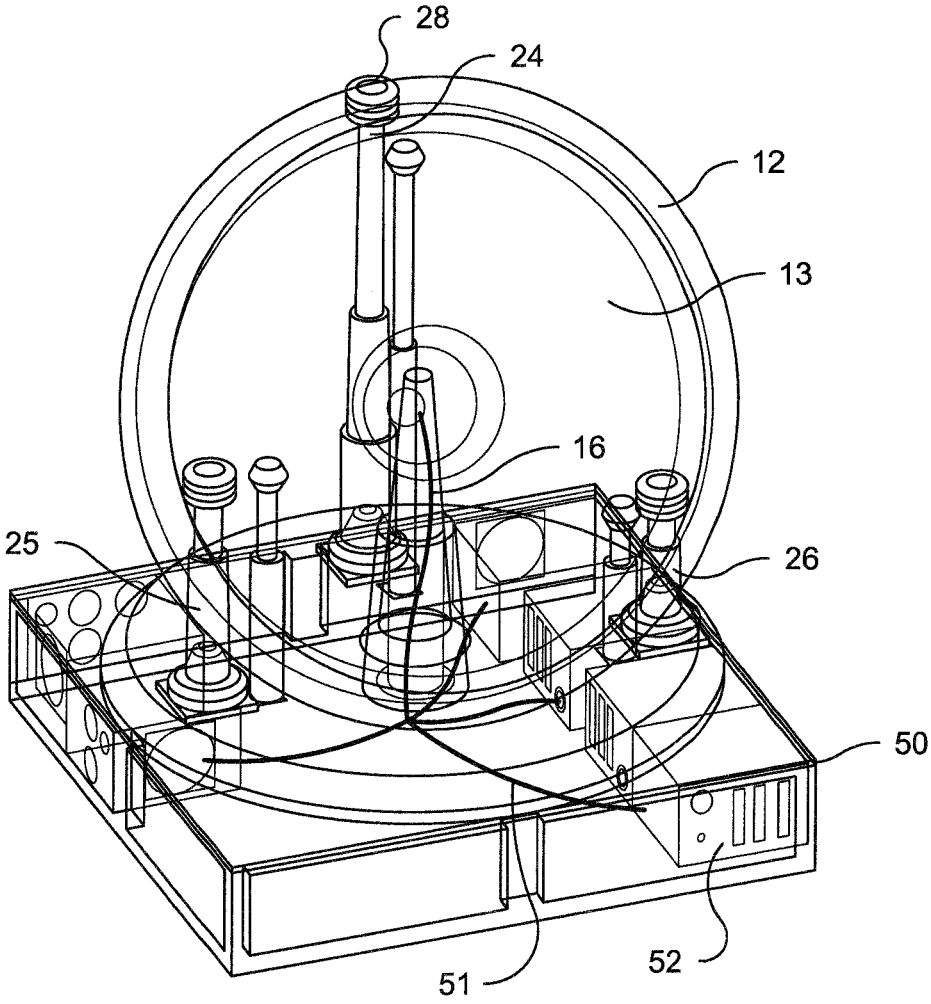
FIG. 5 is an transparent isometric view of the radar system according to an embodiment of the present invention showing the centralized routing of supporting feeds.

Referring generally to FIG. 5, a primary advantage of the center support 16 is the ability to route all connection hardware 51, such as wiring, fiber optics, pneumatic or hydraulic lines, and coolant piping through the center support 16. In addition to simplifying routing, this arrangement centralizes critical systems, and improves balance by centralizing weight. As described above, because the antenna array 12 of the present invention is not rotating, the wires, piping, and associated connections may only have to be fitted with conventional strain relief to withstand the pivoting of the antenna array, rather more expensive and unreliable couplers such as slip rings and rotary fluid joints.

Figure 6:
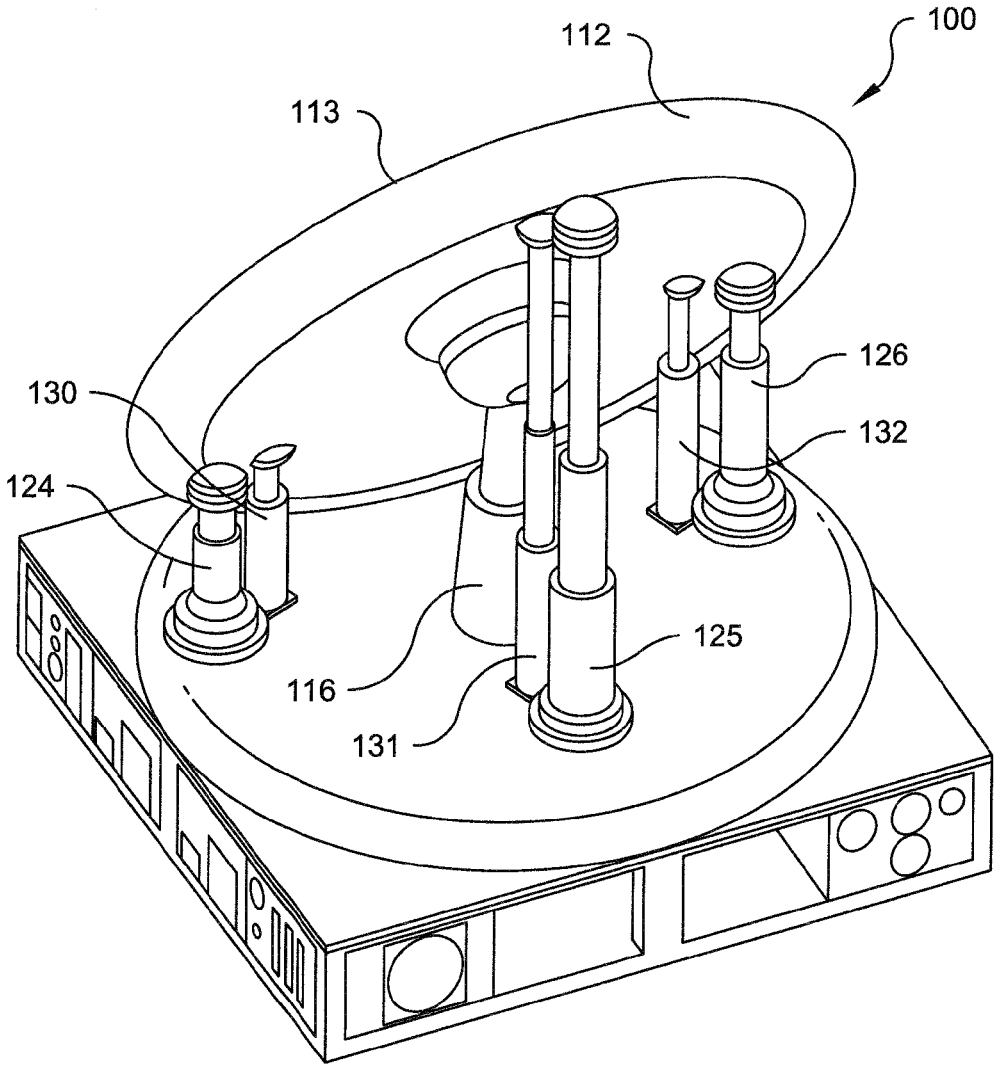
FIG. 6 is an isometric view of an embodiment of the present invention with the antenna array pivoted by three drive actuators.

While two actuators 24,25 are shown in FIGS. 1-4, it is envisioned that any number of actuators may be utilized without departing from the scope of the invention. For example, if only limited azimuth coverage is required, a single actuator could be used. Likewise, three or more actuators may be utilized. For example, FIG. 6 shows a radar system 100 comprising three actuators 124,125,126 and three counterbalances 130,131,132. Operation of the radar system 100 is similar to that described above in previous embodiments of the present invention with respect to the tilting and azimuth control of the antenna array 112. The use of more actuators and counterbalances provides an increase in load carrying capacity, as well as an increase in stiffness of the antenna array 112. The accompanying reduction in antenna array flex leads to more precise control. Accordingly, this configuration is beneficially utilized either to support a larger, more powerful antenna array, and/or be installed in geographical areas which present harsh operating conditions, notably high wind and heavy precipitation.

While the foregoing describes exemplary embodiments and implementations, it will be apparent to those skilled in the art that various modifications and variations can be made to the present invention without departing from the spirit and scope of the invention.

What is claimed is:

1. A pivoting radar system comprising:

a base comprising a generally planar surface;

a support element coupled with the base;

an antenna array for at least one of transmitting and receiving radar signals;

a coupler adapted for pivotally connecting the antenna array to the support element, the coupler configured to enable simultaneous pivoting of the antenna array about at least two axes and with respect to a common pivot point; and at least two linear actuators arranged generally perpendicular to the planar surface of the base, and attached on a first end to the base and contacting the antenna array on a second end, and configured to provide a force to the antenna array to cause said pivoting about the at least two axes with respect to the support element.

2. The radar system of claim 1, wherein the at least two actuators are configured to provide the antenna array with 360 degrees of azimuth revolution with respect to the support element.

3. The radar system of claim 1, wherein the support element is a telescoping support element.

4. The radar system of claim 1, wherein the coupler comprises a spherical bearing.

5. The radar system of claim 1, further comprising a controller, wherein the controller uses an array mapping routine to alter the azimuth position of the antenna array with respect to the position of the base.

6. A pivoting radar system comprising:

a base;

a support element coupled with the base;

an antenna array for at least one of transmitting and receiving radar signals;

a coupler adapted for pivotally connecting the antenna array to the support element, the coupler configured to enable simultaneous pivoting of the antenna array about at least two axes and with respect to a common pivot point;

at least one actuator configured to provide a force to the antenna array to cause said pivoting about the at least two axes with respect to the support element; and at least one counterbalance arranged generally perpendicular to a planar surface of the base, and attached on a first end to the base and on a second end to the antenna array.

7. A method for articulating a radar antenna array comprising the steps of:

pivotally coupling an antenna array to a support member;

pivoting the antenna array about the support member to achieve a predetermined angle with respect to vertical and to alter the azimuth position of the antenna array with respect to the support member; and maintaining the antenna array at the predetermined angle while altering the azimuth position of the antenna array, wherein the step of maintaining the array at a predetermined angle while altering the azimuth position of the antenna comprises simultaneously pivoting the antenna array about a first and a second axis and with respect to a common pivot point, the second axis being orthogonal to the first axis; and wherein the step of simultaneously pivoting the antenna array about the first and second axes comprises applying a force to the antenna array with a first linear actuator at a point radially outward from the common pivot point in the direction of the first axis to cause said pivoting about the second axis, and applying a force to the antenna array with a second linear actuator at a point radially outward from the common pivot point in the direction of the second axis to cause said pivoting about the first axis.

8. The method of claim 7, further comprising the step of:

continually pivoting the antenna array about the support member through 360 degrees of azimuth revolution with respect to the support member.

9. The method of claim 8, wherein a center of the antenna array is revolved in a circular orbit co-axial to a central axis of the support member while the antenna array is pivoted through 360 degrees of azimuth revolution.

10. The method of claim 7, wherein a center of the antenna array is maintained at a constant distance from the support member while the azimuth position of the array is altered at the predetermined angle.

11. A pivoting radar system comprising:

a base;

a support element coupled with the base;

an antenna array for at least one of transmitting and receiving radar signals;

a coupler adapted for pivotally attaching the antenna array to the support element, the coupler configured to enable simultaneous angular rotation of the antenna array about a first axis and a second axis with respect to a common pivot, the second axis being orthogonal to the first axis; and a first linear actuator having a first end attached to the base and a second end contacting the antenna array at a point radially outward from the common pivot in the direction of the first axis, the first linear actuator configured to provide a force to the antenna array to cause said pivoting about the second axis; and a second linear actuator having a first end attached to the base and a second end contacting the antenna array at a point radially outward from the common pivot point in the direction of the second axis, the second linear actuator configured to provide a force to the antenna array to cause said pivoting about the first axis, wherein the first linear actuator and the second linear actuator are configured to alter the azimuth position of the antenna array with respect to the support element while maintaining a constant elevation angle of the antenna array.

12. The radar system of claim 11, wherein the first linear actuator and the second linear actuator are configured to provide the antenna array with 360 degrees of azimuth revolution with respect to the support element.

13. The radar system of claim 12, wherein a center of the antenna array is revolved in a circular orbit co-axial to a central axis of the support element while the antenna array is altered through 360 degrees of azimuth revolution.

14. The radar system of claim 11, wherein a center of the antenna array is maintained at a constant distance from the support element while the azimuth position of the array is altered at the constant elevation angle.

15. The radar system of claim 11, wherein the support element comprises a telescoping support element and the first and second linear actuators comprise telescoping actuators, wherein the telescoping support element and the telescoping actuators are configured to be moveable between a first extended position, and a second retracted position, and wherein, when the telescoping support element and the telescoping actuators are arranged in the second retracted position, the antenna array is oriented generally horizontally, and parallel to a planar surface of the base.

16. The radar system of claim 15, further comprising at least one counterbalance, wherein the at least one counterbalance comprises a telescoping linear actuator.

17. The radar system of claim 11, further comprising at least one counterbalance, wherein the at least one counterbalance is arranged between the base, and a point proximate an outer perimeter of the antenna array.

* * * * *